United States Patent [19]

Sakitani et al.

[11] 4,455,129

[45] Jun. 19, 1984

[54] MULTI-VANE TYPE COMPRESSOR

[75] Inventors: Katsumi Sakitani, Kawachinagano; Takashi Maekawa, Sakai; Satoru Fujimoto, Tondabayashi; Tetsuro Tajima, Sakai; Makoto Hiroyasu, Osaka, all of Japan

[73] Assignee: Daikin Kogyo Co., Ltd., Osaka, Japan

[21] Appl. No.: 302,085

[22] Filed: Sep. 14, 1981

[30] Foreign Application Priority Data

May 21, 1981 [JP] Japan ..... 56-74340[U]
Jul. 22, 1981 [JP] Japan ..... 56-109671[U]

[51] Int. Cl.[3] ..... F01C 21/04; F03C 2/00

[52] U.S. Cl. ..... 418/82; 418/93; 418/268

[58] Field of Search ..... 252/9; 418/82, 93, 97, 418/267, 268

[56] References Cited

U.S. PATENT DOCUMENTS

| | | | |
|---|---|---|---|
| 2,827,226 | 3/1958 | McCormack . | |
| 3,247,116 | 4/1966 | Reiling | 252/58 |
| 3,272,139 | 9/1966 | Rosaen | 418/238 |
| 3,598,510 | 8/1971 | Aoki | 418/268 |
| 3,856,686 | 12/1974 | Sato | 252/28 |

FOREIGN PATENT DOCUMENTS 55-106391 7/1980 Japan .

*Primary Examiner*—Leonard E. Smith
*Assistant Examiner*—Jane E. Obee
*Attorney, Agent, or Firm*—Cushman, Darby & Cushman

[57] ABSTRACT

A multi-vane type compressor formed with vane back pressure spaces having introduced thereinto a suction gas pressure in the suction and compression strokes and a discharge gas pressure in the discharge stroke. The compressor includes supply grooves for introducing the discharge gas pressure into the vane back pressure spaces, which are each split into a trailing side portion and a leading side portion. Each leading side portion for coping with the terminating stage of the discharge stroke is exposed to the discharge gas pressure via a passageway offering large resistance to the flow of fluid, to throttle the gas forced out of the vane back pressure spaces as the vanes are forced into vane grooves to thereby raise the vane back pressure. This is conducive to prevention of the jumping action of the vanes, and wear of the tips of the vanes and to minimization of vibration and noise. The compressor is lubricated by a lubricating oil having a fluorine base solid lubricant mixed and dispersed therein, for avoiding friction loss at the tips of the vanes.

4 Claims, 11 Drawing Figures

MULTI-VANE TYPE COMPRESSOR

BACKGROUND OF THE INVENTION

This invention relates to compressors and more particularly it is concerned with a multi-vane type compressor.

Generally, one of the main losses of powers in a multi-vane type compressor is a friction loss between the tips of the vanes and the inner peripheral surface of the cylinder. If this loss could be reduced, a great reduction in the losses of power would be realized, thereby contributing to improvements in energy efficiency ratio (EER) in a refrigerating machine.

To reduce the friction loss occurring between the tips of the vanes and the inner peripheral surface of the cylinder requires a reduction in forces urging the vanes to move toward the inner peripheral surface of the cylinder. However, if the force urging the vanes toward the inner peripheral surface of the cylinder is low, jumping action would occur when the vanes move in sliding movement along the inner surface of the cylinder, thereby causing noise to be produced and wear and damage to occur. Conversely if the force urging the vanes toward the inner peripheral surface of the cylinder is too high, friction loss would be great and the loss of power would also be great, thereby giving rise to problems that are contradictory in solution.

The force $F_{WA}$ urging the vanes toward the inner peripheral surface of the cylinder can be expressed by the following equation:

$$F_{WA}=F_{IE}+F_{CE}+F_{BA}$$

where $F_{IE}$ is the inertial force applied to the vanes, $F_{CE}$ is the centrifugal force applied to the vanes and $F_{BA}$ is the back pressure applied to the vanes. To avoid the value of $F_{WA}$ becoming too high, $F_{IE}$ and $F_{CE}$ could be reduced by selecting suitable materials for the vanes and altering the dimensions thereof. With regard to $F_{BA}$, it is necessary to reduce the vane back pressure. However, the internal pressure of the cylinder rises as compression progresses, and the force tending to force the vanes backwardly rises, thereby causing jumping action to readily occur. The result of this is that it is necessary to reduce the vane back pressure in the low pressure zone (suction and compression stroke zone) in which the internal pressure of the cylinder is low and to increase the vane back pressure in the high pressure zone (discharge stroke zone) in which the internal pressure of the cylinder is high.

In order to meet these requirements, proposals have hithereto been made to introduce into vane back pressure spaces defined between a plurality of vane grooves formed in the rotor and the bottom surfaces of the vanes slidably fitted in the respective vane grooves, a suction gas pressure in the suction and compression strokes and a discharge gas pressure in the discharge stroke, as disclosed in Japanese Utility Model Application Laid-Open No. 106391/80, for example.

Generally toward the end of the high pressure zone (discharge stroke zone), overcompression takes place in the internal pressure of the cylinder that is higher than the discharge gas pressure. Thus in the proposals referred to hereinabove, the problems have arisen that the jumping action of the vanes is caused to occur by the overcompression and the compressor vibrates, causing noise level to rise.

To avoid this trouble, proposals have been made to introduce into the vane back pressure spaces a pressure of higher level through the entire zone of the discharge stroke, as disclosed in U.S. Pat. No. 2,827,226 granted to Alex A. McCormack, for example. However, an unnecessarily high back pressure is applied to the vanes in the initial zone of the discharge stroke; thereby increasing the friction loss at the tips of the vanes.

Another problem encountered with respect to a multi-vane type compressor concerns lubrication. The tips of the vanes move at high speed in sliding movement while being forced against the inner peripheral surface of the cylinder. This makes good lubrication of this part to be effected difficultly so that there has hitherto been a tendency that friction loss is high, loss of powers in high and seizure and galling are likely to occur. For example, when a multi-vane type compressor of an elliptic shape having a cylinder of a major radius of 35 mm, a minor radius of 30 mm and a thickness of 28.5 mm and vanes of a thickness of 2 mm is operated with a chlorofluorocarbon refrigerant R-22 at a high pressure 20 atg and a low pressure 6 atg, the oil film formed at the tip of each vane is 0.3–1.4 μm, with a mean of about 0.5 μm. Meanwhile the roughness of the surface of the inner periphery of the cylinder is limited to 0.5–1.0 μm when finishes are given by ordinary machining, so that when the oil film has the aforesaid thickness (a mean value of about 0.5 μm), the tip of each vane would be brought to metal-to-metal contact with the inner peripheral surface of the cylinder. This would cause wear to develop on the inner peripheral surface of the cylinder and increase friction work, causing a detrioration in energy efficiency. That is, in such mixed lubrication region, the coefficient of friction ($C_F$) is about 0.02–0.08, with the value of $C_F$ becoming too large.

Meanwhile if it is possible to finish the inner peripheral surface of the cylinder in a manner to reduce the surface roughness below 0.5 μm, fluid lubrication could be achieved and friction loss would be greatly reduced, because the coefficient of friction $C_F$ is about 0.001. However, fine finishing is very expensive and not economical.

SUMMARY OF THE INVENTION

An object of the invention is to provide a multi-vane type compressor in which the problems of vibration and noise are obviated by positively preventing the jumping action of the vanes while reducing the friction loss occurring at the tips of the vanes by raising the vane back pressure in the terminating stage of the discharge stroke to a level higher than the discharge gas pressure.

Another object of the invention is to provide a multi-vane type compressor capable of reducing friction occurring on the inner peripheral surface of the cylinder with which the vanes are brought into sliding contact even if ordinary finishes are tolerated for the surface of the cylinder, when the compressor is operated by using a chlorofluorocarbon refrigerant and lubricated with a mixture of dispersed fluorine base solid lubricant, such as graphite fluoride and/or tetrafluoroethylene resin with a lubricating oil.

Additional and other objects, features and advantages of the invention will become apparent from the description set forth hereinafter when considered in conjunction with the accompanying drawings.

DESCRIPTION OF THE PREFERRED EMBODIMENTS

Figure 1:
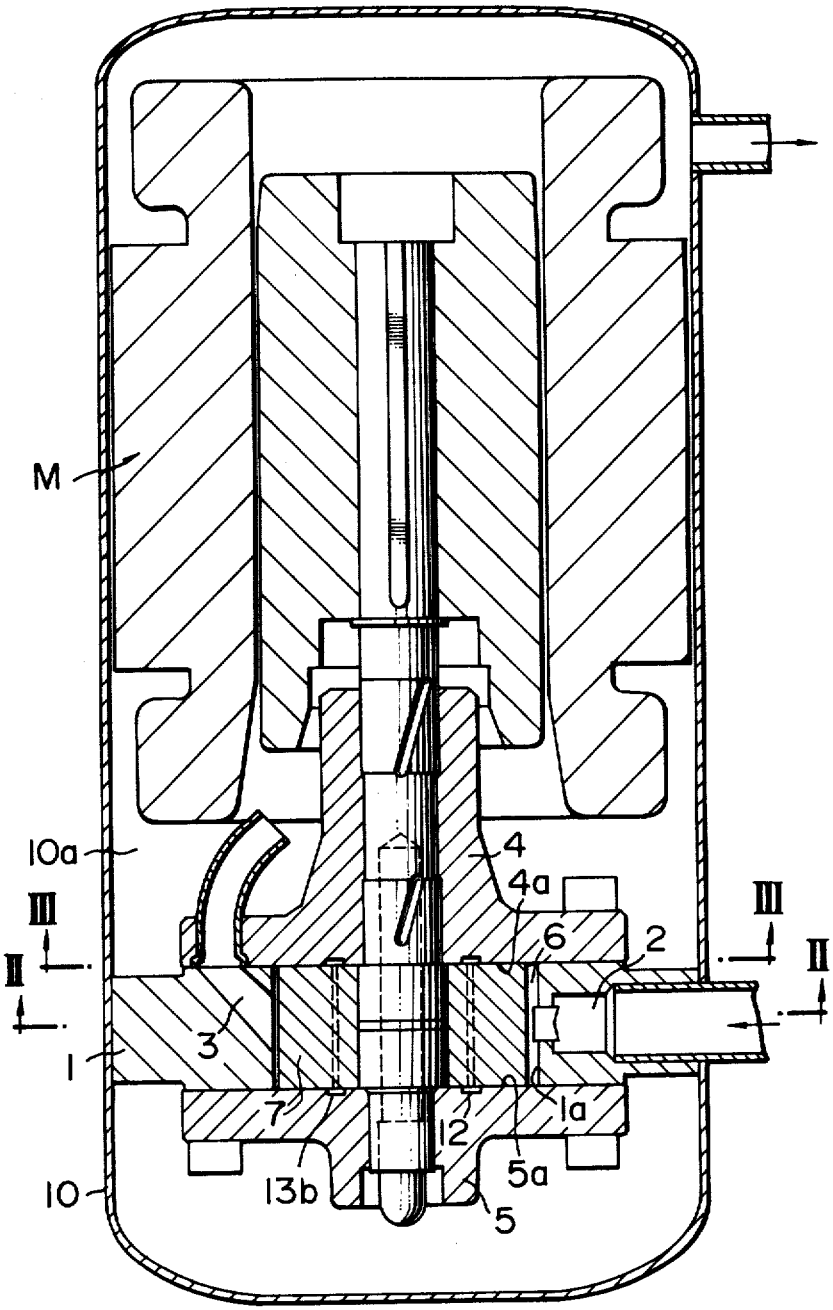
FIG. 1 is a vertical sectional view taken along the line I—I in FIG. 2 showing the multi-vane type compressor comprising one embodiment of the invention.
Figure 2:
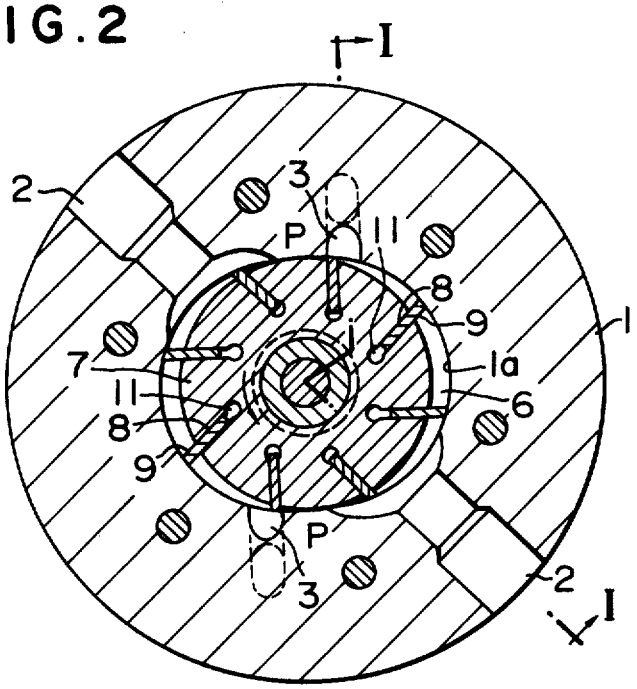
FIG. 2 is a horizontal sectional view taken along the line II—II in FIG. 1.
Figure 3:
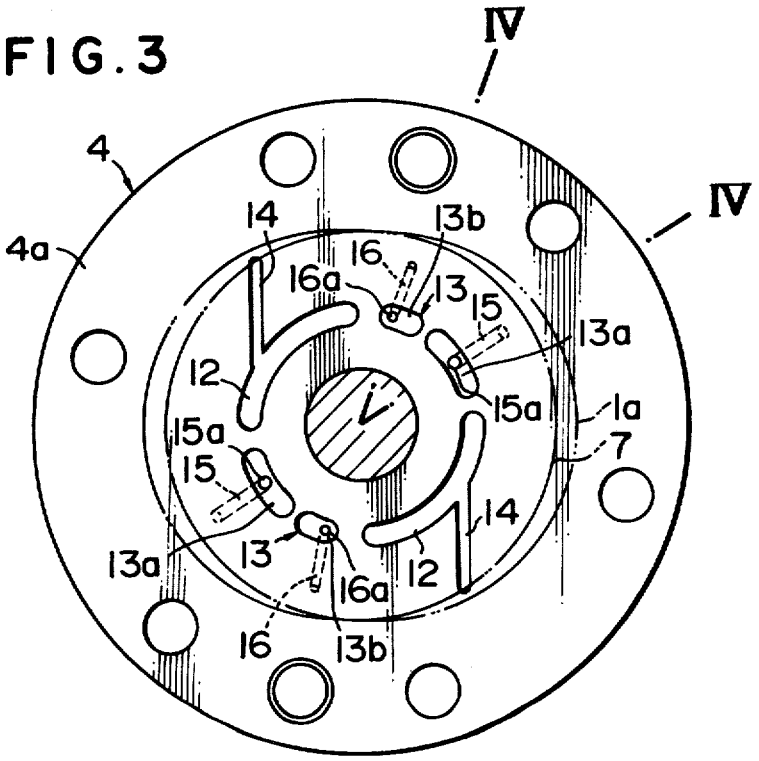
FIG. 3 is a horizontal sectional view taken along the line III—III in FIG. 1.

FIGS. 1 to 4 show one embodiment of the invention which is incorporated in a multi-vane type compressor of an elliptic shape. As shown, the compressor comprises a elliptic cylinder 1 formed with two suction ports 2 and two discharge ports 3 located symmetrically. The cylinder 1 is closed at its upper end by a front head 4 provided with a flat face 4*a* and at its lower end by a rear head 5 provided with a flat face 5*a*. The cylinder 1 has an elliptic inner peripheral surface 1*a* which cooperates with the upper and lower flat faces 4*a* and 5*a* to define a compression chamber 6. Housed in the compression chamber 6 is a rotor 7 having a circular outer peripheral surface and opposite flat side surfaces and driven by a motor M for rotation. The rotor 7 is in contact with the inner peripheral surface 1*a* of the cylinder 1 at two points P, P and formed with a plurality of (eight in the embodiment shown) vane grooves 8 arranged substantially radially at a predetermined pitch or spacing interval to open at the outer peripheral surface and at two sides. Sliding vanes 9 are each slidably fitted in one of the vane grooves 8 with the tip of each vane 9 pressing against the inner peripheral surface 1*a*. These parts are constructed such that a refrigerant in a gaseous state drawn by suction into the compression chamber 6 via the suction port 2 is successively compressed as the volume of a chamber surrounded by the leading and trailing vanes 9, cylinder inner peripheral surface 1*a*, rotor outer peripheral surface and upper and lower faces 4*a* and 5*a*, before being discharged via the discharge port 3. The numeral 10 designates a dome.

Formed in juxtaposed relation to vane back pressure spaces 11 each defined between one of the vane grooves 8 and the bottom of associated one of the vanes 9, on the upper and lower faces 4*a* and 5*a* of the front head 4 and the rear head 5 respectively are annular first supply grooves 12 of an arcuate angle corresponding to the suction and compression strokes and annular second supply grooves 13 corresponding to the discharge stroke which are arranged on the same pitch circle. The upper and lower faces 4*a* and 5*a* are further formed with a first passage 14 communicating at one end with the compression chamber 6 in the suction and compression strokes and at the other end with the first supply grooves 12 for introducing a suction gas pressure.

Figure 4:
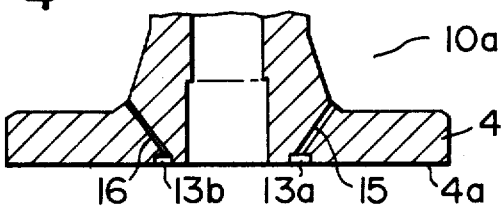
FIG. 4 is a horizontal sectional view taken along the line IV—IV in FIG. 3.

The second supply grooves 13 are each split into a trailing side portion 13*a* and a leading side portion 13*b* which are rearweadly of and forwardly of the direction in which the vanes 9 move respectively. The trailing side portion 13*a* has an opening 15*a* of the second passage 15 of a larger diameter, and the leading side portion 13*b* has an opening 16*a* of a third passage 16 of a smaller diameter than the second passage 15. As shown in FIG. 4, the second passage 15 and third passage 16 are independently in communication with a dome space 10*a* in the dome 10, so that the discharge gas pressure in the dome space 10*a* can be introduced into both the trailing side portion 13*a* and the leading side portion 13*b* of each second supply groove 13.

Figure 7:
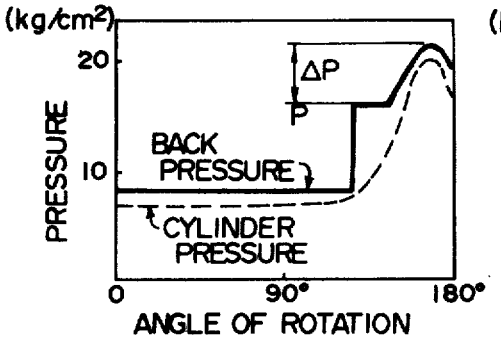
FIG. 7 is a graph showing the vane back pressure characteristic of the multi-vane type compressor according to the invention.

Operation of the aforesaid embodiment will be described. In the suction and compression strokes, the suction gas pressure is introduced into the vane back pressure spaces through the first passage 14 and first supply grooves 12, so that the vane back pressure can be kept at a slightly higher value than the internal pressure of the cylinder 1 as shown in FIG. 7, thereby permitting vane back pressure to be greatly reduced.

Meanwhile in the discharge stroke, the discharge gas pressure (dome space pressure) is introduced into the vane back pressure spaces 11 through the second passage 15 and the trailing side portions 13*a* of the second supply grooves 13 and the third passage 16 and the leading side portions 13*b* of the second supply grooves 13. The result of this is that as shown in FIG. 7, in the initial stage of the discharge stroke, the gas in the back pressure spaces 11 is forced to flow into the dome 10 through the trailing side portions 13*a* and the second passage 15 when the vanes 9 are forced into the associated vane grooves 8. However, since the second passage 15 is of a large size, it offers substantially no resistance to the flow of fluid, the vane back pressure is substantially equal to the discharge gas pressure or slightly higher than that. Meanwhile in the terminating stage of the discharge stroke, the gas in the back pressure spaces 11 is forced to flow into the dome 10 through the leading side portions 13*b* of the second supply grooves 13 and the third passage 16. Since the third passage 16 is of a smaller diameter, it offers great resistance to the flow of fluid, so that the squeeze effect brings the gas pressure in the back pressure spaces 11 to a level higher than the discharge gas pressure P by $\Delta P$ and the vane back pressure can be kept at a higher level than the internal pressure of the cylinder 1 which is in overcompression condition. This enables the jumping action of the vanes 9 to be positively prevented and allows frictional dragging of the tip of each vane 9 on the inner peripheral surface 1*a* of the cylinder 1 to be lessened, thereby reducing vibration and noise.

Figure 8:
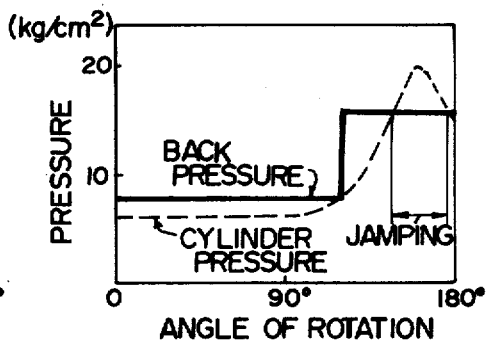
FIG. 8 is a graph showing the vane back pressure characteristic of a compressor of the prior art.

FIG. 8 shows the relation between the vane back pressure and the internal pressure of the cylinder of a multi-vane type compressor of the prior art. A comparison of FIG. 8 with FIG. 7 will show that the present invention can achieve effects in preventing the occurrence of the jumping action of the vane.

Experiments were conducted by operating the multi-vane type compressor according to the invention under the following conditions; the center angles of the trailing side portion 13a and the leading side portion of each second supply groove were 40° and 20° respectively; the supply grooves 12 and 13 had a diameter of 34 mm, a width of 3 mm and a depth of 2 mm; and the second passage 15 and the third passage 16 had diameters of 3 mm and 1 mm respectively and lengths of 13.5 mm respectively. At the experiments, when the dome pressure (discharge pressure P) was 19 kg/cm$^2$ and the suction pressure was 6.8 kg/cm$^2$, $\Delta P = 3$ to 4 kg/cm$^2$. And the vibration was reduced from an overall 6 G to an overall 0.8 G and the noise was reduced from 70 dB (A) to 67 dB (A).

Figure 5:
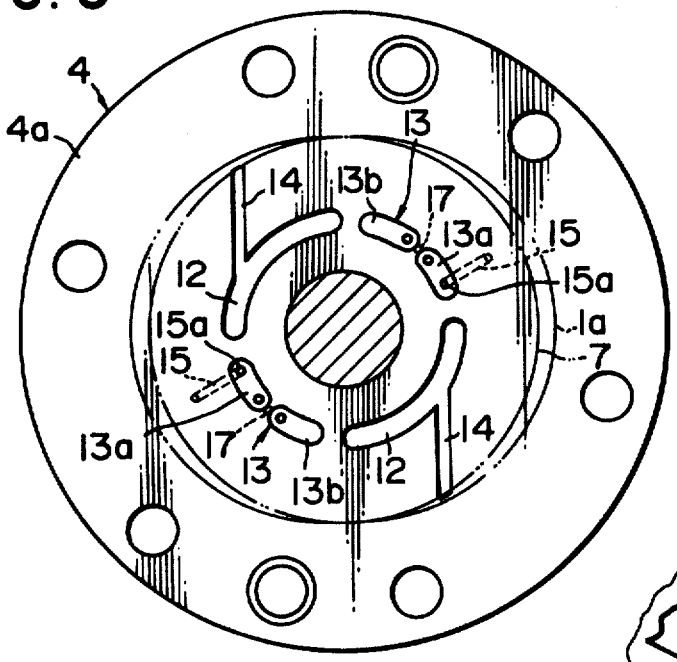
FIGS. 5 and 6 are horizontal views corresponding to FIG. 3, showing other embodiments of the multi-vane type compressor in conformity with the invention.
Figure 5A:
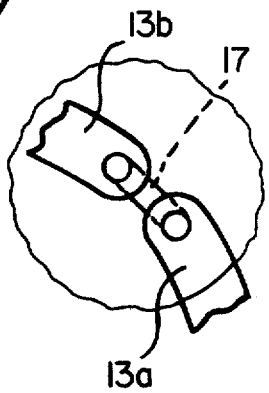
FIG. 5A is an enlarged view of duct 17 of the present invention.

FIG. 5 shows a modification of the embodiment shown in FIGS. 1–4. In the modification too, the second supply grooves 13 are each split into the trailing side portion 13a and the leading side portion 13b, the trailing side portion 13a communicating with the dome space 10 via the second passage 15 of a larger diameter. The third passage 17 of a smaller diameter opening in the leading side portions 13b is connected to the trailing side portions 13a, in place of being directly connected to the dome space 10, so that the leading side portions 13b can be communicated with the dome space 10 via the third passage 17, trailing side portions 13a and second passage 15. By this arrangement, the following effects can be achieved. In the description of operation, operation of the modification shown in FIG. 5 similar to that of the embodiment shown in FIGS. 1–4 will be omitted.

In the discharge stroke, the discharge gas pressure (dome space pressure) is introduced into the vane back pressure spaces 11 via the second passage 15 and second supply grooves 13. As shown in FIG. 7, in the initial stage of the discharge stroke, since the vane back pressure spaces 11 are directly in communication with the trailing side portions 13a, the gas in the vane back pressure spaces 11 is immediately released into the dome space as the vanes 9 are forced into the vane grooves 8, so that the vane back pressure can be kept at a level substantially equal to or slightly higher than the dome space pressure. Meanwhile at the terminating stage of the discharge stroke, the gas in the vane back pressure spaces 11 flows out via the leading side portions 13b and the third passage 17 of smaller diameter as the vanes 9 are forced into the grooves 8, causing the initial discharge gas pressure P to rise by $\Delta P$, so that the vane back pressure is kept at a level higher than the internal pressure of the cylinder 1 which is in overcompression condition. This is conducive to positive prevention of the jumping action of the vanes 9, reduction of wear caused on the forward ends of the vanes 9, and reduction of noise and vibration.

Figure 6:
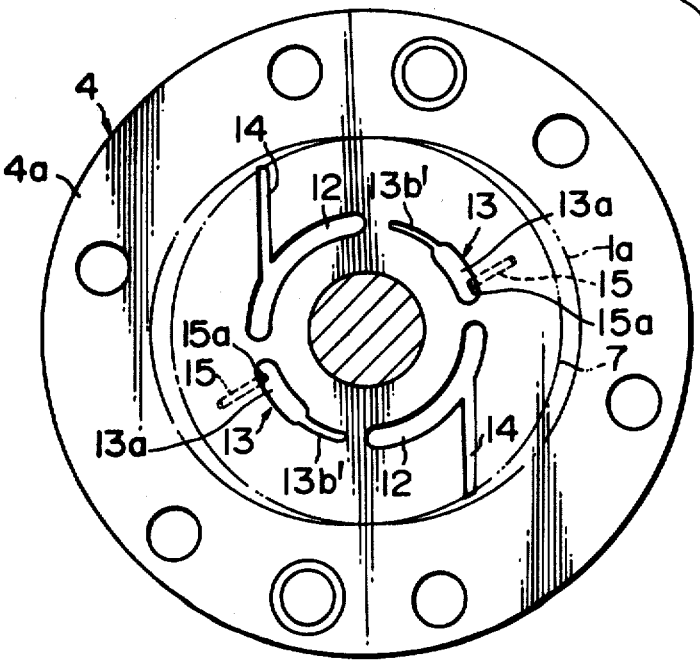

FIG. 6 shows a modification of the embodiment shown in FIG. 5, in which the second supply grooves 13 are each split into the trailing side portion 13a and the leading side portion 13b', with the trailing side portion 13a having the opening 15a of the second passage 15 connected thereto. In this modification, the leading side portions 13b' have a smaller width than the trailing side portions 13a and are directly connected to the trailing side portions 13a. The leading side portions 13a of grooves of smaller width concurrently serve as the third passage 16, 17 of the embodiments of FIGS. 1–4 and FIG. 5 respectively. The embodiment shown in FIG. 6 can achieve the same effects as described by referring to the embodiment shown in FIG. 5.

In the description set forth hereinabove the invention has been incorporated in a multi-vane type compressor of an elliptic shape. It is to be understood that the invention can be incorporated in various types of sliding-vane type compressors including multi-vane type compressors of other elliptic shape or cylindrical shape, rolling-piston type compressors or expansion means, capacity-type turbines or other fluid machines, with the same effects being achieved.

In the embodiments shown and described hereinabove, the first and second supply grooves 12 and 13 are formed in the upper and lower faces 4a and 5a of the front head 4 and rear head 5 respectively. However, the invention is not limited to this arrangement of the first and second supply grooves 12 and 13 and the first and second supply grooves 12 and 13 may be formed in either one of the faces 4a and 5a or the first supply grooves 12 may be formed in one of the faces 4a and 5a and the second supply grooves 13 may be formed in the other face. The invention can achieve the aforesaid effects irrespective of the arrangement of the first and second supply grooves 12 and 13.

In a multi-vane type compressor of an elliptic shape shown in FIGS. 1–6, the lubricant used contains a solid lubricant in particulate form with a mean particle size of 0.01–2.0 μm dispersed in 0.1–5.0 weight parts in 100 weight parts of a refrigerating machine oil which forms the base lubricant. The solid lubricant may comprise graphite fluoride, tetrafluoroethylene resin, $MoS_2$, $WS_2$, graphite, mica, sulfur, etc. Of these materials, graphite fluoride is superior in antiwear and friction modifying properties and can achieve the lubricating effect with a small volume. Tetrafluoroethylene resins (including from a high polymer of tetrafluoroethylene to a low polymer in wax form) are also superior in antiwear and friction modifying properties. An additional feature of graphite fluoride and tetrafluoroethylene resins is their high thermal stability.

In mixing and dispersing one of the aforesaid solid lubricants in a lubricating oil, the solid lubricant of the aforesaid mean particle size is blended with the lubricating oil and the mixture is agitated for a short period of time with a conventional agitator. When the solid lubricant used in a fluorine base lubricant, such as graphite fluoride, tetrafluoroethylene resin, etc., mixing and dispersing thereof in the lubricating oil can be advantageously effected if the solid lubricant is immersed in alcohol or other organic solvent beforehand before being blended with the lubricating oil, with increased lubricating performance.

Generally, a solid lubricant is liable to be adversely affected by a working fluid (generally a chlorofluorocarbon refrigerant) of a fluid machine. However, when a fluorine base solid lubricant, such as graphite fluoride, tetrafluoroethylene resin, etc., is used, this problem can be obviated. Moreover, since the fluorine base solid lubricant has high thermal stability, it exhibits superb peformance in an ordinary operating range of a refrigerating machine. As a chlorofluorocarbon refrigerant is dissolved into the refrigerating machine oil, it is possible to avoid seizure and galling when a foaming phenomenon occurs at startup by virtue of the deposition of the solid lubricant on the lubricating surface.

Besides the mixture of graphite fluoride or tetrafluoroethylene resin with the lubricating oil, a mixture of both graphite fluoride and tetrafluoroethylene resin with the lubricating oil is desirable, because the lubricant mixture combines the advantages of the two.

When the mean particle size of the solid lubricant is above 2.0 μm, sedimentation readily takes place due to the force of gravity and the mixture has poor dispersion stability. On the other hand, when the particle size is below 0.01 μm, the particles themselves tend to adhere to each other to produce secondary particles due to their inherent poor dispersion stability even if the particle size is in the range of colloidal particle, particularly in the case of graphite fluoride or tetrafluoroethylene resin. Thus the lubricant mixture has poor dispersion stability and is unable to exhibit good lubricating performance. Thus according to the invention, the mean particle size is set at 0.01-2.0 μm, preferably at 0.01-1.0 μm.

By using the solid lubricant of the aforesaid mean particle size, the solid lubricant blended with the lubricating oil can be all utilized effectively, so that the volume of the solid lubricant need not be so large. The solid lubricant blended with the lubricating oil may be 0.1-5.0 weight parts, preferably 0.1-1.5 weight parts, for 100 weight parts of the lubricating oil. When the solid lubricant is below 0.1 weight part in volume, no satisfactory lubricating performance can be exhibited. When the volume is above 5 weight parts, the effects achieved are saturated and not desirable economically. At the same time, scattering precipitation occur in various portions, causing malfunction of other equipment (such as obturation of an expansion valve).

A lubricating oil used as the base lubricant may be in liquid form at room temperature. It may be selected from the group consisting of hydrocarbon oil of naphthene base, mineral oils, such as paraffin base hydrocarbon oil, synthetic hydrocarbon oil, olefin polymer oil, alkylated aromatic oil, polyester oil, ester oil, halogenated hydrocarbon oil, silicone oil, fluorine oil and vegetable oils. They usually have a viscosity of 5-3000 cp at room temperature.

Besides mixing and dispersing a solid lubricant in a lubricating oil as described hereinabove, other agent, such as interfacial activator, oil property improving agent, corrosion preventing agent, clean dispersion agent, viscosity improving agent, etc., may be added to the mixture of the solid lubricant with the lubricating oil.

Figure 9:
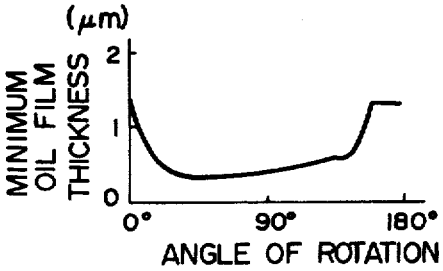
FIG. 9 is a graph showing variations in the thickness of the minimum oil film in the embodiment shown in FIG. 1.

Tests were conducted on lubrication of the multi-vane type compressor of an elliptic shape shown in FIGS. 1-6, operated by using a chlorofluorocarbon refrigerant R-22 under the operating conditions of high pressure 20 atg and low pressure 6 atg, the compressor having a cylinder of a major radius of 35 mm and a minor radius of 30 mm and 8 vanes of a thickness of 2 mm. As a control, a lubricating oil for refrigerating machines, which has a viscosity of 70 cp at 38° C. (the oil having a trade name 'SUNISO 4GS' by Sun Oil Company, Ltd. was used. It was ascertained that the oil film at a tip of each vane had a thickness in the range between 0.3 and 1.4 μm, or a mean thickness 0.5 μm, as shown in FIG. 9. When ordinary machine finishes are tolerated, the surface roughness of about 0.5 to 1.0 μm is the limit, so that the tip of each vane comes into metal-to-metal contact with the inner peripheral surface of the cylinder and frictional dragging occurred on the inner peripheral surface of the cylinder.

When a solid lubricant which was graphite fluoride or tetrafluoroethylene resin was added in 0.1-5.0 weight percents to 100 weight percents of the refrigerating machine lubricating oil and mixed and dispersed therein (hereinafter referred to as the example of the invention), the frictional loss measured showed that the frictional loss at the vane tip was reduced from 160.4 watts of the control (hereinafter referred to as the prior art example) in which the lubricating oil having no solid lubricant added thereto to 32.8 watts in the example of the invention. With regard to the total loss, the value was reduced from 491.0 watts of the prior art example to 349.2 watts of the example of the invention. Thus a coefficient of friction close to fluid lubrication was obtained even if the surface roughness of the cylinder was about 0.8-1.0 μm. No traces of abnormal wear were found on the inner peripheral surface of the cylinder.

Figure 10:
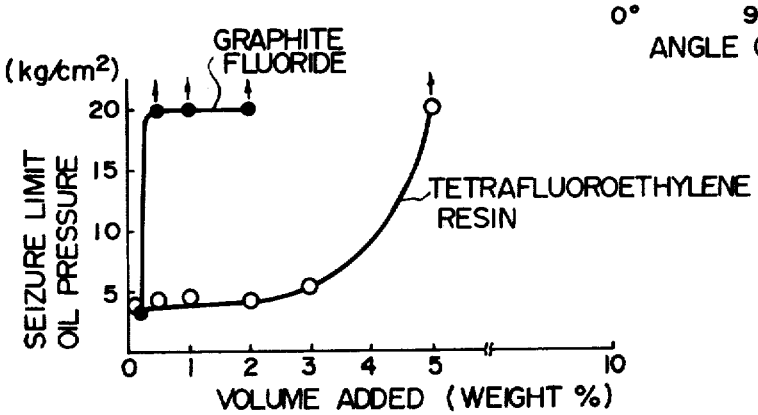
FIG. 10 is a graph showing the results of tests conducted on seizing load applied to the embodiment shown in FIG. 1.

With regard to the example of the invention, the volume (weight percents) of the graphite fluoride or tetrafluoroethylene resin added to the base lubricating oil was varied, to test the seizure limit oil pressure by a four-ball wear and lubrication tester. The results are shown in FIG. 10 in which it will be clear that in the case of graphite fluoride and tetrafluoroethylene resin, a high seizing load is shown in the range of 0.1-5.0 weight percents of the added volume.

What is claimed is:

1. A multi-vane type compressor comprising:

a cylinder formed with at least a suction port and at least a discharge port;

a front head having a flat face for closing one end of said cylinder;

a rear head having a flat face for closing the other end of said cylinder;

a rotor arranged in said cylinder, said rotor having a peripheral surface, flat opposite end surface juxtaposed against said faces respectively, and a plurality of vane grooves opening in said peripheral surface and said opposite end surfaces;

a plurality of vanes each slidably inserted in one of said plurality of vane grooves, each said vane defining by its end surface and the bottom of the associated vane groove a vane back pressure space;

means for defining first supply groove on at least one of the faces of said front head and said rear head, said first supply groove being in fluid connection with the vane back pressure spaces of the vanes in the suction stroke;

first passage means (14) for exposing said first supply groove to the suction gas pressure;

means for defining second supply groove on at least one of the faces of said front head and said rear head, said second supply groove being in fluid connection with the vane back pressure spaces of the vanes in the discharge stroke, said second supply groove including a trailing side portion (13*a*) disposed posteriorly with respect to the direction of movement of the vanes and a leading side portion (13*b*) disposed anteriorly with respect thereto;

second passage means (15) for exposing said trailing side portions (13*a*) to the discharge gas pressure; and third passage means (16, 17, 13*b*') for exposing said leading side portions (13*b*) to the discharge gas pressure:

said third passage means having throttling function with respect to the fluid flowing therethrough, whereby a pressure higher than the discharge gas pressure can be produced in the vane back pressure spaces when the vanes are forced into the vane grooves.

2. A multi-vane type compressor as claimed in claim 1, wherein said third passage means (16) brings said leading side portions (13*b*) into direct fluid communication with a discharge gas space (10*a*) downstream of said discharge port.

3. A multi-vane type compressor as claimed in claim 1, wherein said third passage means comprises a duct (17) of a small diameter each communicating said leading side portions (13*b*) with one of said trailing side portions (13*a*).

4. A multi-vane type compressor as claimed in claim 1, wherein said leading side portions (13*b*) and said third passage means comprise groove (13*b*') of a small width connected to said trailing side portion (13*a*).

* * * * *